United States Patent [19]

Johnson et al.

[11] Patent Number: 4,550,758

[45] Date of Patent: Nov. 5, 1985

[54] EXTERIOR INSULATING FLEXIBLE GLAZED SURFACE COVERING, MOVABLE AND STOWABLE FROM INDOORS

[76] Inventors: Carter F. Johnson; Cheryl L. Larson, both of 3868 Miller Trunk Hwy., Duluth, Minn. 55811; Judy M. Tepley, P.O. Box 7203, Duluth, Minn. 55807

[21] Appl. No.: 530,503

[22] Filed: Sep. 9, 1983

[51] Int. Cl.[4] ..... A47H 3/00; E06B 9/17

[52] U.S. Cl. ..... 160/271; 160/41

[58] Field of Search ..... 160/271–273, 160/319, DIG. 7, 330, 41, 290, 269

[56] References Cited

U.S. PATENT DOCUMENTS

| | | | |
|---|---|---|---|
| 701,932 | 6/1902 | Rankin | 160/319 |
| 2,270,978 | 1/1942 | Swormstedt | 160/271 |
| 2,313,659 | 3/1943 | Mittag | 160/290 R |
| 2,352,609 | 7/1944 | Bates | 160/41 |
| 2,501,454 | 3/1950 | Schueren | 160/273 R |
| 3,732,913 | 5/1973 | Wrono | 160/133 |
| 4,037,639 | 7/1977 | Jones | 160/133 |
| 4,246,952 | 1/1981 | Helldorfer | 160/271 |
| 4,256,808 | 3/1981 | Roy et al. | 428/421 |
| 4,261,410 | 4/1981 | Standiford | 160/269 |
| 4,344,474 | 8/1982 | Berman | 160/121 |
| 4,357,978 | 11/1982 | Keller et al. | 160/271 |
| 4,359,079 | 11/1982 | Bledsoe | 160/269 |
| 4,369,827 | 1/1983 | Anderson | 160/41 |
| 4,397,346 | 8/1983 | Chumbley et al. | 160/DIG. 7 |
| 4,398,585 | 8/1983 | Marlow | 160/271 |

*Primary Examiner*—Peter M. Caun

*Attorney, Agent, or Firm*—Douglas L. Tschida

[57] ABSTRACT

An exteriorly mounted, insulated curtain-like window covering, which can be placed in and removed from covering relation thereto from the interior of the building. The covering comprises a weatherproof envelope including a pair of metallic film layers and an intermediate insulative barrier. An overlying driven roller and idler roller, along with side mounted keyways and upper and lower contacting seals, support and controllably permit the raising and lowering of the covering relative to the window and the storing of the covering when the window is uncovered.

6 Claims, 6 Drawing Figures

EXTERIOR INSULATING FLEXIBLE GLAZED SURFACE COVERING, MOVABLE AND STOWABLE FROM INDOORS

BACKGROUND OF THE INVENTION

1. Field of Invention:

This invention relates to window insulation and specifically to an exteriorly applied retractable, flexible, insulating glazed surface covering (hereinafter referred to as a curtain) which operates from the interior of the building.

2. Discussion of the Prior Art:

Heretofore, window insulation systems for protecting a living space from massive thermal exchange at windows during heating and cooling seasons have been principally located in the interior of the building. Such systems are commonly constructed from materials, including cloth, paper and plastic. They can function in tracks or hang free and they may be insulated or uninsulated. Rolled curtains and Roman shades with various devices and materials to allow sealing at the perimeter and for storing the curtain when not in use, represent two of the most common types of construction.

A primary problem, however, that arises with the use of interiorly mounted curtains is that it is difficult to provide a perfect seal between the curtain and window against convection. Convection of heated, humid interior air to the glazed surface, which has a temperature that is much cooler than the ambient room air, results in condensation and frost buildup when the curtains are closed. Upon opening such a curtain or shade and exposing the window to sunlight, the frost melts rapidly. What results is a mess, damaging the window sills, walls, floors, and carpet. Additionally, water borne films rapidly develop on the glass. This filming requires constant cleaning if one intends to sustain passive solar efficiency. Furthermore, windows having interiorly mounted curtains are more likely to break from thermal shock.

Available curtain systems also have other drawbacks. One is storage, namely, where and how does one store these devices. A second problem arises with the decor, since they frequently have their own designs which can be aesthetically unpleasant. They also present handling problems in that they are bulky and, in exceptional circumstances, children, handicapped or elderly persons may have great difficulty in operating these devices.

Exteriorly mounted insulating systems, on the other hand, are inherently free of condensation, since they allow the innermost glass to warm to a temperature which is close to the ambient interior temperature. Various systems have been tried. On the market are the Solaroll TM and the Pease Rolling Shutter TM systems. These systems provide an R (resistance factor) rating of nearly 1, which is minimal. These two systems are chiefly designed to provide security, as claimed in their own advertising literature. Canvas, Roman shades, rollup shades and other coverings held with grommets have also been tried on the exterior, each again having a very low R rating. Another layer of transparent material may be added over the glazed surface, such as Mylar TM, Plexiglass TM, vinyl or glass, again with a very low R. Finally, rigid insulation can be placed over the exterior of the glazed surface by hand, nailed, bolted, placed on hinges or in tracks.

Currently, the best exterior window insulation is provided by permanently covering the window with a rigid insulation covered with a reflective surface. Its major drawbacks are its appearance, and the difficulties encountered upon attempting to remove them. The window becomes a wall, allowing for no light to enter the living area and for no one to look out.

Movable rigid metallized foam placed on tracks or hinges are next best, but they are difficult to seal. They also require a place for storage when not in use, which is rarely available on the exterior walls of buildings, and which is also unsightly in the daylight hours. Storing this type of insulation on the exterior of the building also requires one to cover and uncover the windows twice a day, regardless of weather conditions. These rigid systems also allow some convection and conduction loss because they are not air tight. Still further, they are easily breakable and can be dangerous to handle in a wind.

Exterior canvas applications provide little protection from conduction, convection and radiant heat loss. Mylar or other translucent films allied permanently to the glazed surface add very little to conduction resistance, and while they may reduce convection losses, they do not alter radiant losses. In addition, they can distort the view and reduce solar gain. Plexiglass and glass also reduce solar gain.

In summary, the major disadvantages of interior insulating window systems are storage space, insufficient area to move the insulation to the storage position, decor and condensation problems, with resultant water damage. The major disadvantages of exterior insulating window systems as grouped by material are that films, glass, plexiglas and canvas are ineffective regarding prevention of heat loss and provide no security. Foam and other rigid insulating materials, on the other hand, present storage and other handling problems because they must be removed by hand from the exterior of the building under all weather conditions. The Pease and Solaroll systems, in turn, have little insulating value and are expensive beyond they insulating worth, as well as being subject to breakage.

Accordingly, several objects of our invention are that it mount to the outside of the structure and that it be sealable, movable and retractable. Other objects are that it present a high resistance to thermal transfer from conduction, convection and radiation. In particular, these objects are achieved in a curtain that is operable from inside the building. In its covering position it is sealed at the sides by tracks in which it glides and at the top and bottom by contact-type seals. When the sun shines, solar energy can thus be collected in the building by either pulling an activating rope, turning a crank or throwing a switch so as to uncover the window and roll the curtain into its storage position, with no problems of condensation on either glazed surface of the window. The curtain stays in the storage position indefinitely, or until its insulating properties are again required.

Still other objects, advantages, and distinctions of our invention, as well as its construction, will become apparent from a consideration of the drawings and ensuing description thereof.

DESCRIPTION OF THE PREFERRED EMBODIMENT

Figure 1:
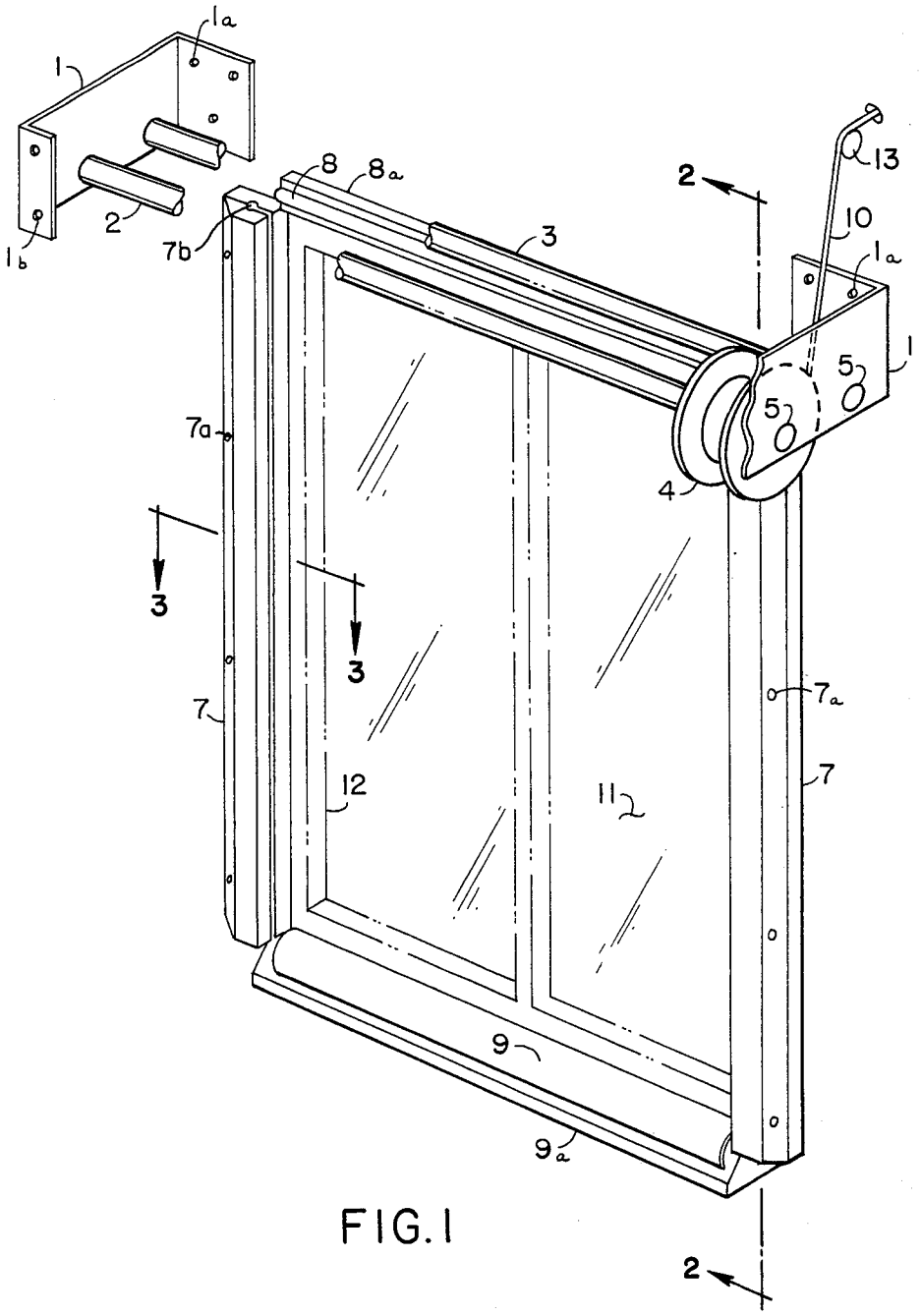
FIG. 1 is a perspective view of our invention.
Figure 2:
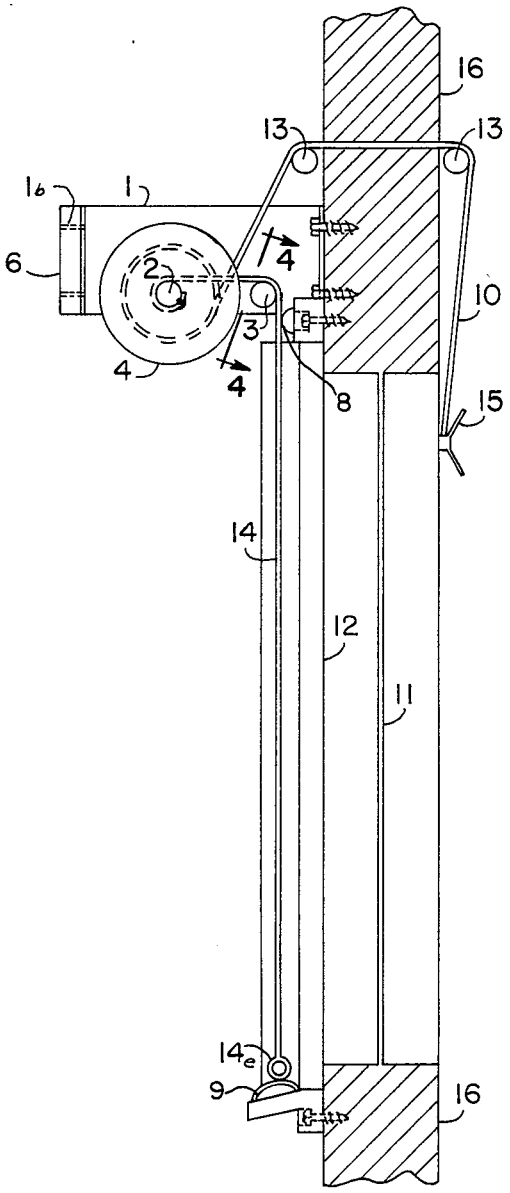
FIG. 2 is a side, cross section view of our invention, indicated by the section lines 2—2 in FIG. 1.
Figure 4:
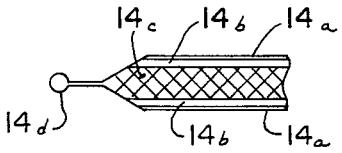
FIG. 4 is a cross-sectional view in detail of the portion of our invention indicated by the section lines 4—4 in FIG. 2.
Figure 6:
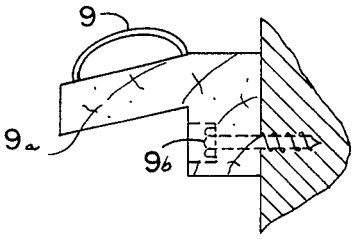
FIG. 6 is a detailed cross-sectional view of the sill curtain seal.

Construction: Referring to FIGS. 1 and 2 and, in particular, to the cross-section view of FIG. 2, the curtain (14) of the present invention is intended to completely cover the glazed surface (11) of the building (16), extending to or slightly beyond the window frame (12) in all directions a distance defined by the curtain mounting apparatus (1–9). From FIG. 4, the exterior insulating window curtain (14) comprises a sandwich of a weather resistant exterior envelope (14*a*), metallic membranes (14*b*), insulating material (14*c*) and a round seal (14*d*), all of which are arranged in such a way as to enhance the insulating qualities of the curtain (14). Mounted to the top of the curtain (14) are attachments (not shown) that join the curtain (14) to a power axle (2). The bottom of the curtain (14) contains a relatively heavy rigid bar (18*e*) which compresses an insulated lower seal (9) and permits the curtain (14) to descent evenly, see also FIG. 6. The curtain (14) thus attaches at its top to the power axle (2) and extends back toward the glazed surface (11), draping over an idler roller (3). The power axle 2 and idler roller (3) are supported at their opposed ends in the bearings (5) mounted to right and left idler brackets (1). On one end of the power axle (2) is located a power source and a reel (4) that together convey rotational energy to the power axle (2), thereby raising or lowering the curtain (14). As shown in FIG. 2, the present power source or means for supplying rotational energy to the power axle (2) comprises a rope-like member (10) which enters the building (16) above the reel (4). Specifically, the rope (10) is supported on pulleys (13) located on the interior and exterior of the building (16) and which permit the operation of the curtain (14) without undue friction. The rope (10) is also adjustably secured to the interior of the building (16) by a cleat (15).

Turning attention to FIG. 1, the idler brackets (1) mount to the exterior wall of said building (16), above and to each side of the glazed surface (11). The brackets (1) support the axle (2) and the idler roller (3) so that the idler roller (3) and the axle (2) are parallel to said building wall (16) and to the upper seal (8) and the lower seal (9). The sides of said brackets (1) containing the bearings (5) thus mount perpendicular to said glazed surface (11). The brackets (1) are also attached to the building (16) by means of weather-resistant fasteners (1), such as screws or the like. A covering valance (6) (reference FIG. 2) mounts to the outermost ends of the brackets (1) by means of other weather-resistant fasteners (1*b*).

Figure 3:
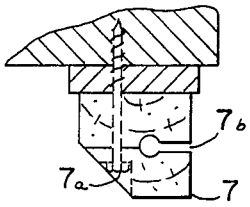
FIG. 3 is a cross-sectional view in detail of the portion of our invention indicated by the section lines 3—3 in FIG. 1.
Figure 5:
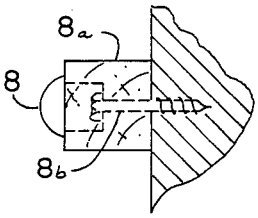
FIG. 5 is a detailed cross-sectional view of the upper curtain seal.

With continuing attention to FIG. 1 and also to FIG. 3, the keyway glide tracks (7) carry the rounded vertical edges (14*d*) of the curtain (14). The keyway glide tracks (7) are mounted parallel to each other and to the vertical portions of the frame (12) or to the outer sides thereof and in perpendicular relation to the axle (2), idler roller (3), upper seal (8) and lower seal (9). The keyway glide tracks (7) are also slightly longer than the vertical height of the frame (12). As depicted, the tracks (7) have keyways (7*b*) formed therein and into which said round seals (14*d*) feed and are retained firmly in place, so that the wind cannot dislodge them and so that water and wind are essentially isolated from the glazed surface (11). The upper seal (8) mounts to the building (16) by way of a mounting strip (8*a*) and suitable fasteners (8*b*), such as screws, reference FIG. 5. The lower seal (9), in turn, mounts to the building (16) by way of a mounting strip (9*a*) and fasteners (9*b*), reference FIG. 6.

OPERATION:

In use and depending upon whether the glazed surface (11) is to be uncovered or not, the curtain (149 is rolled onto and off of the power axle (2). In the up position, all of the curtain (14) is essentially wound on the power axle (2), leaving the glazed surface (11) unobstructed. In the down position, the curtain (14) completely covers the glazed surface (11). From its connection on the power axle (2), the curtain (14) lies over the idler roller (3) in supported relation thereto and contacts the upper seal (8) on its way into the keyway glide tracks (7). When in motion, the power axle (2) rotates to allow the curtain (14) to roll over the idler roller (3), providing a smooth, nonbinding operation. The round seals (14*d*) to either side of the curtain (14), then slide into and along the keyway glide tracks (7), which are bolted on or beside the window frame (12). These tracks (7), in combination with the round seals (14*d*), seal the sides of the curtain (14). The curtain (14) cannot be forced out of the tracks by wind buffeting or pulling.

The power axle (2) and idler roller (3) rest and rotate in the idler brackets (1). The brackets (1) are mounted to the building (16) above the keyway tracks (7) and to either side of the glazed surface (11). The curtain (14), when moving downward over the idler roller (3), encounters the upper seal (8) at the top of the glazed surfaces (11), and which seal (8) is mounted to overlap the path of travel, so that the curtain is firmly held against the seal (8), thereby preventing air from entering from this side of the curtain (14).

The means of supplying rotational energy to the power axle (2) as indicated in the drawing is a rope (10), which attaches to the reel (4) on one end of the power axle (2). The reel (4) rotates with the operator's pulling of the rope (10) and which causes the power axle (2) to similarly rotate, thereby raising or lowering the curtain (14). The curtain (14) is lowered with the aid of the weighted rigid bar (14*e*), located in the bottom of the curtain (14), which allows gravity to assist in the covering operation. The high torque reel (4), in turn, takes up the rope (1) as the curtain (14) is lowered into covering relation to the glazing surface (11). The rope (10) leads from the reel (4) to the exterior pulley (13), through a small hole in the wall of the building (16) to the interior pulley (13). The operator can thus raise and lower the curtain (14) from the interior of the building (16). In order to raise the curtain (14), the rope (10) is pulled toward the operator in an inward direction until the curtain (14) is in the desired position and at which point the rope (10) is secured to the cleat (15). In its fully retracted position, the curtain (14) is stowed around the power axle (2) and rolls out of sight behind the valance (6).

As should be apparent from the foregoing, the curtain (14) is the major insulating component of the present system. As mentioned, it includes an envelope (14*a*) that is resistant to mildew, moisture, sunlight (ultraviolet) degradation and air penetration (movement). The envelope (14*a*) also encloses a pair of metallic membranes (14*b*) and an insulating substance (14*c*) and all of which are joined together near the vertical edges. On each vertical edge of the curtain (14), an attached round seal (14*d*) enables the curtain (14) to move in the keyway glide tracks (7). At the base of the curtain (14), a rigid bar (14*e*) provides a means for creating an airtight seal with the lower seal (9). The rigid bar (14*e*) is weighted so that the lower edge of the curtain (14) compresses the lower seal (9) and also allows the curtain (14) to gravity feed. When the curtain (14) is fully extended, it thus seals off a relatively airtight space between itself and the glazed surface (11). This airtight space being accomplished via the contacting engagement of the curtain (14) with the upper seal (8), the keyway glide tracks (7) and the lower seal (9). The net result of this array of seals achieving a greatly inhibited thermal exchange between the outside air and inside air when the curtain is lowered, without the adverse effects of existing devices.

While the above description is made with respect to the presently preferred embodiment, it should not be considered in limitation of the scope of the invention, but rather is intended only as an exemplification of one preferred embodiment thereof. For example, many other variations of supplying rotational energy to the power axle (2) are possible. An electric motor which drives a belt, chain, gear or friction clutch can supply rotational energy to the power axle (2) and can be used in replacement of the rope (10), pulleys (13), and reel (4). As presently contemplated, the electric motor would be controlled by the operator from the interior of the building (16) by means of an electric switch.

The reel (4) may also be replaced with a flywheel, to which are attached chains, belts or gears, which can supply rotational energy to the power axle (2) from the interior of the building (16) by means of a crank. This crank would be located on the interior of the building and attach to the power axle (82) through the wall of the building (16) via a crankshaft.

Another design for the curtain (14) that would not require furling the curtain (14) around the power axle (2), would require an extension of the glide tracks (7) above the glazing surface (11), so that the curtain (14) could be raised in its entirety, to fully extend above the frame (12) of the window, providing the building (16) had the necessary area above the window to support the curtain when not in use. This design would, of course, also necessitate a change in the position of the pulleys (13), roller (2), etc. and require a longer rope (10).

Accordingly, the scope of the invention should be determined not by the embodiment illustrated, but the appended claims and their legal equivalents.

What is claimed is:

1. Exteriorly mounted window covering apparatus comprising:

a nontransparent window covering member including first and second layers of a weather resistant ultraviolet impermeable material mounted in surrounding relation to an insulative layer having a relatively large R rating and wherein the peripheral edges of said first and second layers are sealed to one another with two opposed edges each including a lengthwise extending beal-like portion of a thickness greater than the combined thickness of said first and said layers, said window covering further including a weighted member mounted along one peripheral edge orthogonal to said bead including edges:

means mountable to a window for storing and guiding said covering member in relation to said window and wherein said covering member is rotatively coupled to a first roller and rotatively supported by a second roller such that said covering can be furled around and released from said first roller as desired;

means mounted to opposed sides of said window in tangential relation to said second roller for receiving said bead-like edges of said window covering in sliding relation thereto;

first seal means mounted to said window orthogonally of the path of travel of said window covering at one end of said slide means in overlapping wiping relation to said window covering so as to contact the back of said window covering as it passes over said second roller; and second seal means mounted to said window at the end of said guide means opposite said first seal means for compressively mating with said weighted member upon extending said window covering in covering relation to said window, said slide means and said first and second seal means thereby forming a substantially airtight space between said window covering and the glazed surface of said window.

2. Apparatus as set forth in claim 1 including:

rope means extending from the interior of a wall containing said window covering apparatus and in winding relation to a storage spool mounted to said first roller for raising and lowering said window covering;

means mounted interiorly of the wall containing said window covering apparatus for fixedly securing said rope thereto and thereby permitting said window covering to be positioned in any partial covering condition desired relative to said window.

3. Apparatus as set forth in claim 1 wherein said second seal means comprises a convex compressivelly resilient member mounted to a window sill, said member being formed from a resilient weather proof material and of a sufficient radius so as to compress upon contact with said weighted member of said window covering.

4. Apparatus as set forth in claim 1 wherein said first seal means comprises a convex resilient weather proof member sufficiently resilient to compress along the length thereof upon contacting said window covering.

5. Apparatus as set forth in claim 1 wherein said window covering includes first and second light and heat reflective layers mounted beneath said respective first and second weather resistant layers.

6. Exteriorly mounted window covering apparatus comprising:

a nontransparent window covering member comprising first and second layers of a weather resistant ultraviolet impermeable material mounted in surrounding relation to an insulative layer having a relatively large R rating and including first and second light and heat reflective layers mounted on opposed sides of said insulative layer and wherein the peripheral edges of said first and second layers are sealed to one another with two opposed vertical edges each including a lengthwise extending bead-like portion of a thickness greater than the combined thickness of said first and said layers, said window covering further including a weighted member mounted along a bottom horizontal edge;

means mountable above the top of a window for storing and guiding said covering member in relation to said window and wherein said covering member is rotatively coupled to a first roller and rotatively supported by a second roller such that said covering can be furled around and released from said first roller as desired;

keyway means mounted to opposed vertical sides of said window in tangential relation to said second roller for receiving said bead-like edges of said window covering in sliding relation thereto;

first seal means horizontally mounted to the top of said window in overlapping wiping relation to said window covering so as to contact seal the back of said window covering as it passes over said second roller;

second seal means horizontally mounted to the sill of said window for compressively mating with said weighted member upon extending said window covering in covering relation to said window said keyway means and said first and second seal means thereby forming a substantially airtight space between said window covering and the glazed surface of said window.

* * * * *